US007239252B2

(12) United States Patent
Kato

(10) Patent No.: US 7,239,252 B2
(45) Date of Patent: Jul. 3, 2007

(54) COMMUNICATIONS SYSTEM AND PROGRAM

(75) Inventor: Koji Kato, Toyoake (JP)

(73) Assignee: Denso Corporation, Kariya (JP)

( * ) Notice: Subject to any disclaimer, the term of this patent is extended or adjusted under 35 U.S.C. 154(b) by 346 days.

(21) Appl. No.: 11/059,689

(22) Filed: Feb. 17, 2005

(65) Prior Publication Data

US 2005/0195095 A1 Sep. 8, 2005

(30) Foreign Application Priority Data

Mar. 5, 2004 (JP) ..... 2004-062500

(51) Int. Cl.
*G08G 1/00* (2006.01)
*G08G 1/096* (2006.01)

(52) U.S. Cl. ..... 340/932.2; 340/426.16; 340/426.28; 340/463; 701/300

(58) Field of Classification Search ..... None
See application file for complete search history.

(56) References Cited

U.S. PATENT DOCUMENTS 4,892,014 A * 1/1990 Morell et al. ..... 477/92
5,751,973 A * 5/1998 Hassett ..... 705/13
6,405,132 B1 * 6/2002 Breed et al. ..... 701/301
6,650,999 B1 * 11/2003 Brust et al. ..... 701/213
6,850,898 B1 * 2/2005 Murakami et al. ..... 705/13
2003/0169193 A1 * 9/2003 LeReverend et al. ..... 341/143
2005/0003844 A1 * 1/2005 Nishiga et al. ..... 455/517
2005/0237225 A1 * 10/2005 Jesadanont et al. ..... 340/932.2

FOREIGN PATENT DOCUMENTS

JP A-H09-189561 7/1997
JP A-2000-285391 1/1998
JP A-H10-91898 4/1998
JP A-2002-183887 6/2002

* cited by examiner

*Primary Examiner*—Benjamin C. Lee
*Assistant Examiner*—Son Tang
(74) *Attorney, Agent, or Firm*—Posz Law Group, PLC

(57) ABSTRACT

A communications system in a first vehicle sends departing information indicating that the first vehicle is about to depart from a parking space along with the vehicle information of the first vehicle when a door is unlocked, a key is inserted, and an engine is started. When the sent departing information is received by a communications system in a different second vehicle that is searching a parking space, the sent vehicle information of the first vehicle is shown in a display device in the second vehicle. The vehicle information includes the number of the license plate, the vehicle kind, the vehicle color, and the vehicle class. The driver of the second vehicle can easily determine whether a nearby vehicle where an occupant is present is the first vehicle that sends the departing information.

15 Claims, 7 Drawing Sheets

FIG. 6A
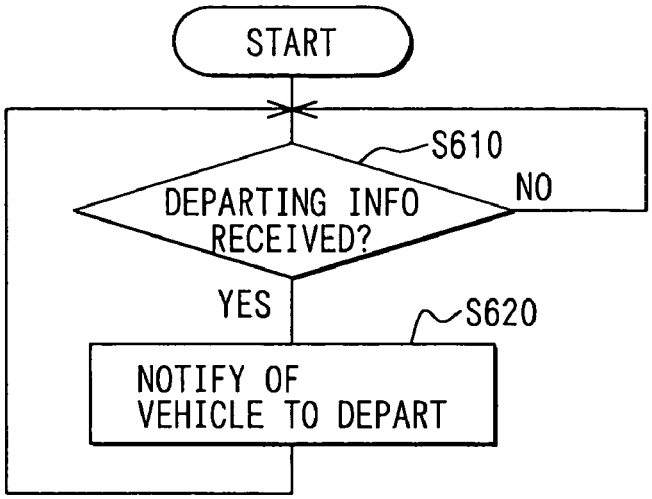
FIG. 6B
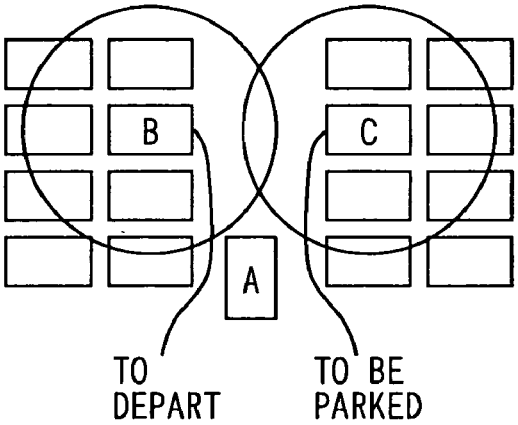
FIG. 6C
| | NO. | KIND | COLOR | CLASS |
|---|---|---|---|---|
| 1 | | | | |
| 2 | | | | |
| 3 | | | | |
| ⋮ | ⋮ | ⋮ | ⋮ | ⋮ |

| | NO. | KIND | COLOR | CLASS |
|---|---|---|---|---|
| DEPART 1 | | | | |
| DEPART 2 | | | | |
| DEPART 3 | | | | |
| PARKED 1 | | | | |
| PARKED 2 | | | | |
| PARKED 3 | | | | |

COMMUNICATIONS SYSTEM AND PROGRAM

CROSS REFERENCE TO RELATED APPLICATIONS

This application is based on and incorporates herein by reference Japanese Patent Application No. 2004-62500 filed on Mar. 5, 2004.

FIELD OF THE INVENTION

The present invention relates to a communications system to communicate, between vehicles, information used for determining availability of parking spaces.

BACKGROUND OF THE INVENTION

Parking lots including parking structures without mechanical movement include a type that a driver searches a parking space and a type that an attendant guides a driver to a parking space. In these parking lots, it is sometimes difficult to find a vacant parking space. In particular, in a large parking structure, even if an attendant is deployed, it is difficult for the attendant to always find a vacant parking space under a condition where many vehicles come and go. Therefore, a driver needs to find a vacant parking space by oneself.

To solve the above problem, a guidance-type parking system is known that directs a vehicle to a parking space. In this system, vacant parking spaces are shown in a display, e.g., in an entrance of a parking structure to let drivers to know the usable or available parking spaces. Further, this system sometimes includes direction display units such as lane markers disposed on all passages within the parking structure to guide drivers to vacant parking spaces by lighting up the lane markers leading to the relevant parking spaces. (Refer to Patent Document 1).

Patent Document 1: JP-2000-285391 A

However, the above guidance-type parking system needs significant investment for the display, the lane markers, and the like, so that such a guidance-type parking system is not adopted in the most parking structures. As the result, a driver needs to find a usable parking space by oneself to park a vehicle in it.

When a driver finds a usable space, there is the following problem even if the parking structure is not crowded. That is, when a person is near a parked vehicle, a driver expects that the person drive the parked vehicle to depart from the space. The driver thereby sometimes tries to wait until the vehicle departs. In this case, when the person is actually about to ride on the parked vehicle, there is a reason for the driver to wait. In contrast, when the person has just left the parked vehicle, the parked area is not available. The driver thereby needs to find another space. Here, the driver sometimes moves the vehicle in a direction reverse to the predetermined traveling direction to find another parking space. This adversely affects overall smooth parking behavior flows of vehicles in the parking structure.

Further, suppose a case that an attendant guides a driver to a vacant space and, at this moment, a parked vehicle near the entrance of the parking structure that is used also for an exit is about to depart from the space. In this case, the attendant needs to guide the driver to a certain space remote from the entrance if the certain space alone is available at this moment. This does not meet user's intention to park the vehicle near the entrance of the parking structure.

SUMMARY OF THE INVENTION

It is an object of the present invention to provide a communications system capable of communicating between vehicles information enabling a driver to determine availability of parking spaces.

To achieve the above object, a communications system mounted in a vehicle is provided with the following. A communicating unit is included to have a wireless communications area to execute an inter-vehicle communication. A vehicle state detecting unit is included for detecting at least one state of the vehicle. A determining unit is included for determining at least one of whether the vehicle enters a parked state where the vehicle is to be parked and whether the vehicle enters a departing state where the vehicle is to depart based on the detected vehicle state. A transmission controlling unit is included for causing the communicating unit to send parking information indicating that the vehicle enters the parked state when that the vehicle enters the parked state is determined, and departing information indicating that the vehicle enters the departing state when that the vehicle enters the departing state is determined.

Under this structure, it can be determined whether the parked vehicle with an occupant being seated or present near the parked vehicle is a vehicle to depart from the parking space or a vehicle to be parked by using the sent departing information or parking information.

Further, as an additional aspect of the present invention, this structure can include a notifying unit that executes, when at least one of parking information and departing information is received from another communications system via the communicating unit, at least one of a notification indicating that a vehicle to be parked is present and a notification indicating that a vehicle to depart is present based on the received at least one of parking information and departing information. This notifying unit enables a driver of a vehicle that receives the departing or parking information to securely know the presence of a vehicle to depart or a vehicle to be parked.

BRIEF DESCRIPTION OF THE DRAWINGS

The above and other objects, features, and advantages of the present invention will become more apparent from the following detailed description made with reference to the accompanying drawings. In the drawings:

FIG. 6A is a flow chart diagram of a third notification process using vehicle information;

FIGS. 6B, 6C are diagrams for explaining the third notification process;

DETAILED DESCRIPTION OF THE PREFERRED EMBODIMENTS (Explanation of Communications System 1)

Figure 1:
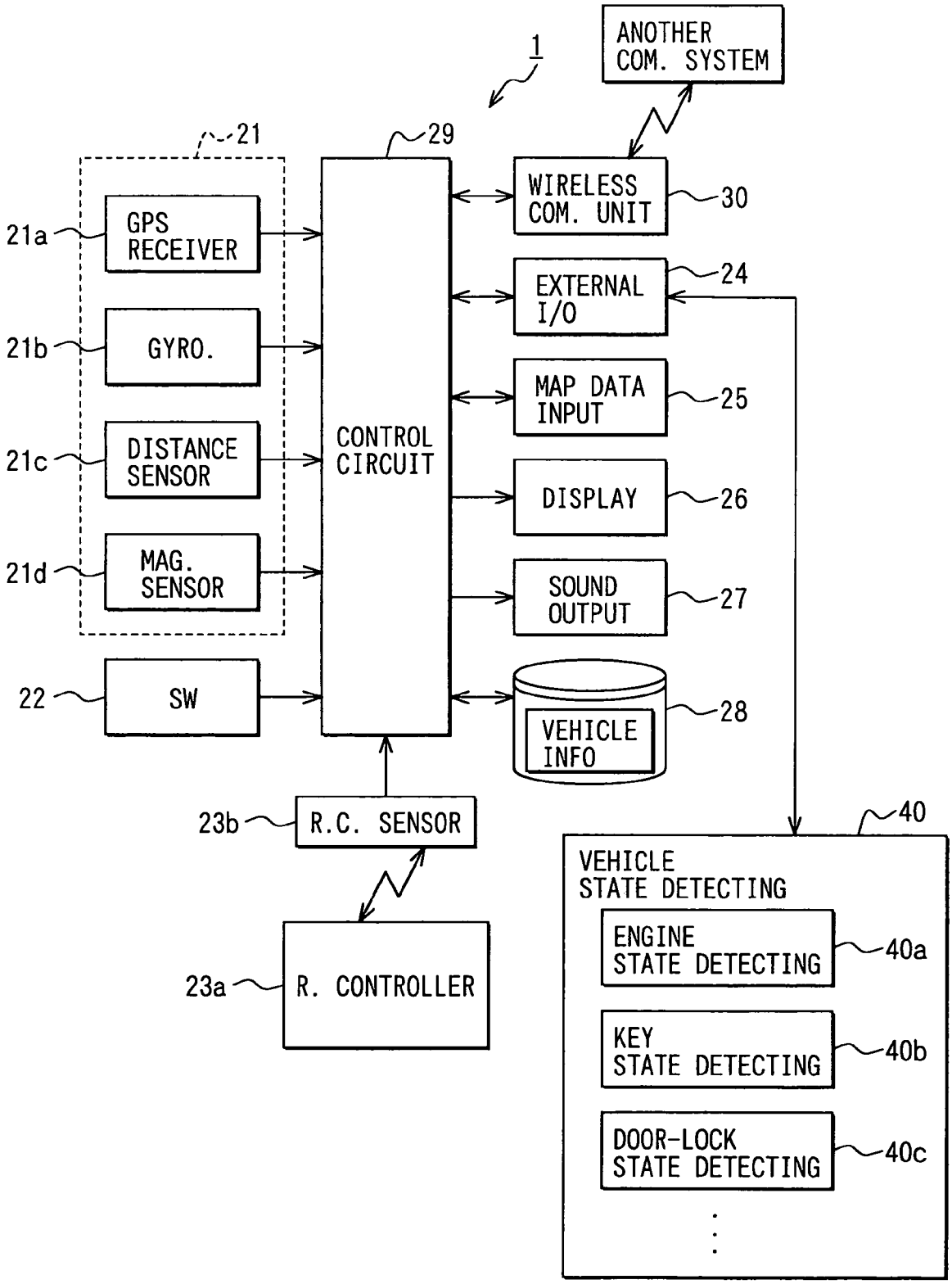
FIG. 1 is a block diagram of a schematic structure of a communications system according to an embodiment of the present invention.

A schematic structure of a communications system 1 according to an embodiment of the present invention is shown in FIG. 1. The communications system 1 is mounted in a subject vehicle, and includes a function of car navigation. The communications system 1 includes the following components: a position detector 21 for detecting a current position of the vehicle; a manipulation switch group 22 for a user to input various instructions; a remote controller 23*a* for the user to input various instructions like the manipulation switch group 22; a remote control sensor 23*b* for receiving signals from the remote controller 23*a*; an external input and output (I/O) device 24; a map data input unit 25 for inputting map data or the like from an external storage medium storing map data or other information; a display device 26 for displaying various displays such as a map display screen or a TV screen; a sound output device 27 for outputting various guidance or the like; a storage device 28 for storing various data; a wireless communications unit 30; and a control circuit 29. The control circuit 29 executes various processes according to inputs from the position detector 21, the manipulation switch group 22, the remote controller 23*a*, the external I/O device 24, the map data input nit 25, and the storage device 28. Further, the control circuit 29 controls the position detector 21, the manipulation switch group 22, the remote control sensor 23*b*, the external I/O device 24, the map data input nit 25, the display device 26, the sound output device 27, the storage device 28, and the wireless communications unit 30.

The position detector 21 includes the following sensors: a Global Positioning System (GPS) receiver 21*a*, a gyroscope 21*b*, a distance sensor 21*c*, and a magnetometric sensor 21*d*. The GPS receiver 21*a* detects a current position, advancing direction, traveling speed of the vehicle by receiving radio waves from the GPS satellites. The gyroscope 21*b* detects rotational movement applied to the vehicle. The distance sensor 21*c* detects a traveled distance using acceleration in the frontward and backward directions of the vehicle. The magnetometric sensor 21*d* detects an advancing orientation from geomagnetism. Each of the above sensors has a differently characterized error, so that it is designed that the respective sensors are complemented by each other. Further, depending on the required accuracy, only some of the sensors can be used. Otherwise, a wheel sensor such as a rotation sensor of a steering can be additionally adopted.

The manipulation switch group 22 is a touch panel integrated with the display device 26 or mechanical key switches surrounding the screen of the display device 26. The touch panel integrated with the display device 26 can be a pressure-sensitive, magnetically inductive, or electrostatic capacitance type, or a type combining the foregoing.

The external I/O device 24 that conducts input and output of various external information receives signals from a vehicle state detection unit 40; FM broadcasting signals via a radio antenna (not shown); or radio wave beacon signals or light beacon signals via fixed stations disposed along roads for the Vehicle Information Communication System (VICS) service. Here, the vehicle state detection unit 40 includes an engine detection unit 40*a*, a key detection unit 40*b*, and a door-lock detection unit 40*c*. The engine state detection unit 40*a* detects whether an engine (not shown) is started or stopped. The key detection unit 40*b* detects whether a key is inserted to a key cylinder or drawn off. The door-lock detection unit 40*c* detects whether a door is locked or unlocked.

The map data input unit 25 is used for inputting the following data: road data as network data; map data such as map-matching data for increasing position detection accuracy; mark data indicating facilities; and other data including image or sound data for guidance. The storage medium for these data can be a CD-ROM, a DVD-ROM, a storage device, a memory, a memory card, or the like.

The display device 26 is a color display device of a liquid crystal display, a plasma display, a CRT, or the like. The display device 26 can show on its screen a map and additional data to superimpose the both with each other. Here, the current position of the vehicle is designated from the map data inputted from the map data input unit 25 and the current position detected by the position detector 21. The additional data include a current position mark, a guiding route to a destination, names, landmarks, and marks of entities. Further, guidance for the entities can be also shown in the screen. The sound output device 27 outputs a speech reading guidance of the entity inputted from the map data input unit 25, various guidance, or information obtained via the external I/O device 24.

The wireless communications unit 30 performs inter-vehicle communications or wireless communications with another communications system 1 (or wireless communications unit 30) mounted in another vehicle. The communications method can be a short range communications method of any one of the Dedicated Short Range Communication (DSRC), the BlueTooth (Trade mark), a wireless Local Area Network (LAN), an Ultra Wide Band (UWB) communication, and a milli-meter wave communications. It is preferable that a communications area covers a range, e.g., of a 10-meter radius, recognizable or visible to a driver so that the vehicle parked within the range recognizable from the driver can respond. When the communications area is too large, the driver may not recognize the relevant vehicle that is responding. Naturally, in a wide-vision condition, the communications area can be further extended.

The control circuit 29 consists of a known computer and the like. The computer includes a CPU, a ROM, a RAM, an I/O, and a bus line connecting the foregoing components. The control circuit 29 executes various controls based on programs memorized in the ROM or the like. One of the controls is for assisting a parking space search to be explained later. Other controls include a map display process and a route guiding process.

In the map display process, first a current position of the vehicle is computed as a pair of the coordinates and the traveling direction based on detection signals from the position detector 21. The display device 26 then shows the map surrounding the computed current position, or a map of an area designated by manipulating the manipulation switch group 22 or the remote controller 23*a*. Here, the map surrounding the computed current position is read via the map data input unit 25.

In the route guiding process, first an entity of a destination is selected by manipulating the manipulation switch group 22 or the remote controller 23*a*. Then, an optimum route from the current position to the destination is automatically computed. A route guidance is thereby performed based on the computed optimum route. The method for automatically setting the optimum route uses, e.g., the Dijkstra Method.

The control circuit 29 can exchange information with the communications systems 1 (or wireless communications units 30) of other vehicles via the wireless communications unit 30.

(Explanation of Operation of Communications System 1)

Process for Sending Information when Vehicle is to be Parked

This process will be explained with reference to FIG. 2. This process starts when an ignition switch is turned on.

First, it is determined whether an information sending function is off (S10). Turning on or off the function can be set by a driver using the manipulation switch group 22 or the remote controller 23*a*. When the function is off (S10: YES), the sequence repeats the determination at S10. In contrast, when the function is on (S10: NO), the sequence advances to S20.

At S20, it is determined whether an engine is stopped or not by receiving via the external I/O device 24 an engine state detected by the engine detection unit 40*a*. While the engine is not stopped (S20: NO), the sequence repeats the process at S20. When the engine is stopped (S20: YES), the sequence advances to S30.

At S30, it is determined whether a key is drawn off by receiving via the external I/O device 24 a key state detected by the key detection unit 40*b*. When the key is drawn off (S30: YES), the sequence advances to S40.

At S40, it is determined whether a door-lock is conducted (or a door is locked) by receiving via the external I/O device 24 a door-lock state detected by the door-lock detection unit 40*c*. When the door-lock is conducted (S40: YES), the sequence advances to S50.

At S50, sending outwardly of parking information indicating that the vehicle is to be parked starts via the wireless communications unit 30. After a given time period (e.g., 60 seconds) passes (S60: YES), sending of the parking information is stopped, which ends the process.

In contrast, when the determination at S30 is negated, or the key is being inserted (S30: NO), the sequence advances to S80. At S80, it is determined whether the engine is started or not by receiving via the external I/O device 24 the engine state detected by the engine detection unit 40*a*. When the engine is not started (S80: NO), the sequence returns to S30. When the engine is started (S80: YES), the sequence returns to S20. When the determination at S80 is affirmed, the engine is re-started without the key drawn off even though the engine was stopped once. This means possibility of no intention to park the vehicle, so that the sequence returns to S20 to repeat the process at S20 and the subsequent process.

Further, when the determination at S40 is negated, or the door-lock is not conducted (S40: NO), the sequence advances to S90. At S90, it is determined whether the key is inserted or not by receiving via the external I/O device 24 the key state detected by the key detection unit 40*b*. When the key is not inserted (S90: NO), the sequence returns to S40. When the key is inserted (S90: YES), the sequence advances to S80. When the determination at S90 is affirmed, the key is re-inserted without the door-lock conducted even though the key was drawn off once. This means possibility of no intention to park the vehicle, so that the sequence returns to S80 to determine whether the engine is started.

Further, when the determination at S60 is negated or while the parking information is being continuously sent for the given time period, the sequence advances to S100, where it is determined whether the door-lock is released or not. When the given time period passes without the door-lock released (or the door is unlocked), the sequence advances to S70. In contrast, when the door-lock is released before the given time period passes (S100: YES), sending of the parking information is stopped (S110) and then the sequence returns to S90. When the determination at S100 is affirmed, it means that the door-lock is released in a relatively short period although the door-lock is once conducted to enter the parked state. Namely, the relevant occupant or driver is supposed to return to the vehicle. Therefore, at this moment, there is a possibility of releasing the parked state, so that the sequence returns to S90 to determine whether the key is inserted or not.

On the other hand, it is designed that the driver can set ON or OFF of information sending function by manipulating the manipulation switch group 22 or the remote controller 23*a*. The reason for designing like that is as follows. For instance, there is a case that the driver continues stopping the travel of the vehicle to wait for a passenger to come after the driver starts the engine. In this case, continuing sending the departing information causes another certain driver who searches a parking space to misunderstand. Namely, the certain driver cannot determine the subsequent action since the parked vehicle does not depart from the space although the departing information is continuously outputted. It is efficient that the user can turn off the information sending function when the information should not be sent.

Process for Sending Information when Vehicle to Depart from Parking Space

This process will be explained with reference to FIG. 3. This process starts when an ignition switch is turned on.

First, it is determined whether an information sending function is off (S210). Similarly in the process for sending information when the vehicle is to be parked, turning on or off the function can be set by the driver using the manipulation switch group 22 or the remote controller 23*a*. When the function is off (S210: YES), the sequence repeats the determination at S210. In contrast, when the function is on (S210: NO), the sequence advances to S220.

At S220, it is determined whether the door-lock is released or not by receiving via the external I/O device 24 the door-lock state detected by the door-lock detection unit 40*c*. While the door-lock is not released (S220: NO), the sequence repeats the process at S220. When the door-lock is released (S220: YES), the sequence advances to S230.

At S230, it is determined whether a key is inserted by receiving via the external I/O device 24 the key state detected by the key detection unit 40*b*. When the key is inserted (S230: YES), the sequence advances to S240.

At S240, it is determined whether the engine is started by receiving via the external I/O device 24 the engine state detected by the engine detection unit 40*a*. When the engine is started (S240: YES), the sequence advances to S250.

At S250, sending outwardly of departing information indicating that the vehicle is about to depart from the parked space starts via the wireless communications unit 30. Then, the sequence advances to S260, where it is determined whether the vehicle starts moving. When the vehicle starts moving (S260: YES), sending the departing information is stopped (S270) and the process then ends.

In contrast, when the determination at S230 is negated, or the key is not inserted (S230: NO), the sequence advances to S280. At S280, it is determined whether the door-lock is conducted or not by receiving via the external I/O device 24 the door-lock state detected by the door-lock detection unit 40*c*. When the door-lock is not conducted (S280: NO), the sequence returns to S230. When the door-lock is conducted (S280: YES), the sequence returns to S220. When the determination at S280 is affirmed, the door-lock is re-conducted without the key inserted even though the door-lock was released once. This means possibility of no intention to depart from the parked space, so that the sequence returns to S220 to repeat the process at S220 and the subsequent process.

Further, when the determination at S240 is negated, or the engine is not started (S240: NO), the sequence advances to S290. At S290, it is determined whether the key is drawn off or not by receiving via the external I/O device 24 the key state detected by the key detection unit 40*b*. When the key is inserted (S290: NO), the sequence returns to S240. When the key is drawn off (S290: YES), the sequence advances to S280. When the determination at S290 is affirmed, the key is drawn off again without the engine started even though the key was inserted once. This means possibility of no intention to depart from the parked space, so that the sequence returns to S280 to determine whether the door-lock is conducted or not.

Further, when the determination at S260 is negated or when the vehicle does not move although starting sending the departing information, the sequence advances to S300. At S300, it is determined whether a given time period (e.g., 60 seconds) passes. Before the given period passes (S300: NO), the sequence advances to S310, where it is determined whether the engine is stopped. When the engine is stopped without moving the vehicle (S310: YES), sending the departing information is stopped (S320) and the sequence returns to S290. Further, when the determination at S300 is affirmed, sending the departing information is stopped similarly. This is because turning ON/OFF of the function is not always accurately conducted. Further, it is because the driver waits for a passenger to come while turning on the function, although starting the engine.

When the determination at S310 is affirmed, it means that the engine is stopped again in a relatively short period although the engine is started once to enter the departing state. Therefore, at this moment, there is a possibility of entering the parked state again, so that the sequence returns to S290 to determine whether the key is drawn off or not.

On the other hand, when the given period passes with the engine started (S300: YES), the sequence advances to S270, where sending the departing information is stopped (S270). The process then ends.

Next, notification process performed by a communications system 1 that receives the above parking information or departing information will be explained below.

First Notification Process

Figure 4A:
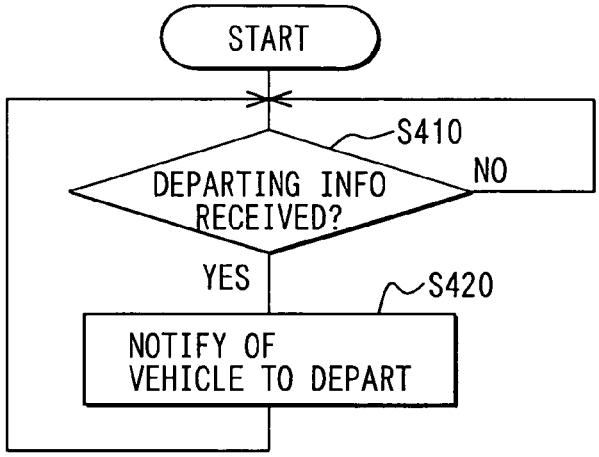
FIG. 4A is a flow chart diagram of a first notification process.

The flow chart of a first notification process is shown in FIG. 4A. In this first notification process, only the departing information is notified. This process is started when the ignition switch is turned on.

First, it is determined whether the departing information is received via the wireless communications unit 30 (S410). The process at S410 is repeated until the departing information is received. When the departing information is received (S410: YES), the sequence advances to S420. At S420, an effect that there is a departing vehicle is notified to a user (or driver) by displaying it on the screen of the display device 26 and by outputting speech from the sound output device 27. In this notification, for instance, a simple notification such as "There is a nearby vehicle that is about to depart" is conducted. After the process at S420 ends, the sequence returns to S410.

Thus, only the presence of the vehicle that is about to depart is notified, so that the user that is searching the usable parking space needs to find it by the presence or absence of an occupant in the nearby vehicles. For instance, in FIG. 4B, the vehicle A that searches a parking space receives the departing information from the vehicle B and the parking information from the vehicle C. (Here, in fact, the wireless communications unit 30 of the vehicle A receives the departing information from the wireless communications unit 30 of the vehicle B and the parking information from the wireless communications unit 30 of the vehicle C. However, hereinbelow, explanation will be done without accurately referring to the wireless communications units 30.) In this case, the driver of the vehicle A is notified of only the departing information from the vehicle B, so that the driver needs to determine which vehicle of the vehicle B and the vehicle C is about to depart by observing the behavior of the drivers of the vehicles B, C. In contrast, in FIG. 4C, the vehicle A receives only the departing information from the vehicle B. In this case, the driver of the vehicle A can easily determine that the vehicle B is about to depart. Here, if the vehicle A receives the parking information from the vehicle B, no notification is performed. Therefore, the driver of the vehicle A determines that the vehicle B is not about to depart even though an occupant is found in the vehicle B.

Second Notification Process

Figure 5:
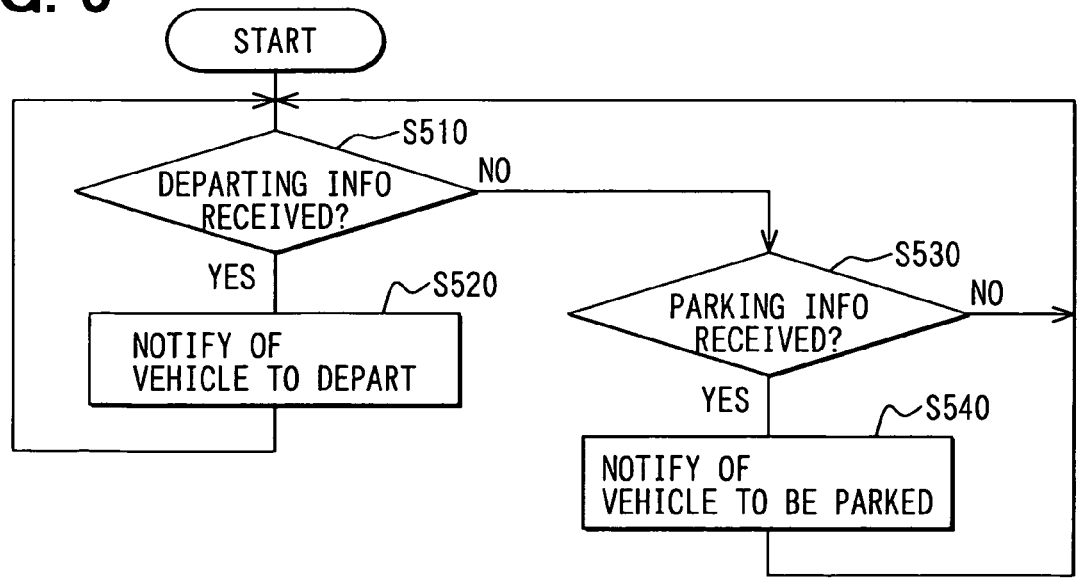
FIG. 5 is a flow chart diagram of a second notification process.

The flow chart of a second notification process is shown in FIG. 5. In this second notification process, the departing information and the parking information are notified. This process is started when the ignition switch is turned on.

First, it is determined whether the departing information is received via the wireless communications unit 30 (S510). When the departing information is received (S510: YES), the sequence advances to S520. At S520, an effect that there is a departing vehicle is notified to a user (or driver) by displaying it on the screen of the display device 26 and by outputting speech from the sound output device 27. When the departing information is not received (S510: NO), the sequence advances to S530. At S530, it is determined whether the parking information is received via the wireless communications unit 30. When the parking information is received (S530: YES), the sequence advances to S540. At S540, an effect that there is a vehicle to be parked is notified to a user (or driver) by displaying it on the screen of the display device 26 and by outputting speech from the sound output device 27. After the process at S540 is completed, the sequence returns to S510. When the determination at S530 is negated, or the parking information and the departing information are not received, the sequence returns to S510. In this notification, for instance, simple notifications such as "There is a nearby vehicle that is about to depart," and "There is a nearby vehicle that is about to be parked" are conducted.

Figure 4B:
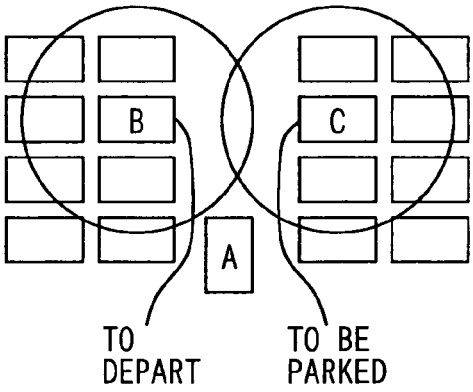
FIGS. 4B, 4C are diagrams for explaining the first notification process.
Figure 4C:
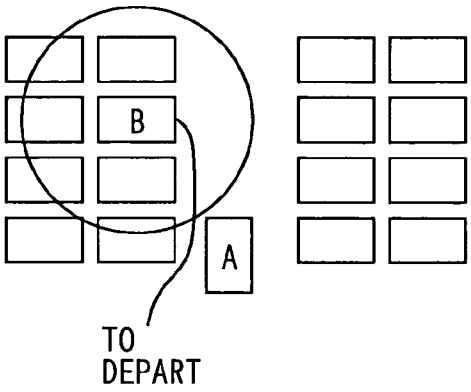

Thus, only the presence of the vehicle that is about to depart or the vehicle that is about to be parked is notified, so that the user that is searching the usable parking space needs to find it by the presence or absence of an occupant in the nearby vehicles. When these notifications are outputted at different timings, the driver can determine whether the relevant vehicle is a vehicle to depart or a vehicle to be parked by the corresponding notification. However, when the departing information and the parking information are received consecutively, it is difficult to determine whether the relevant vehicle is a vehicle to depart or a vehicle to be parked. For instance, suppose a case that the vehicle A that is searching a parking space receives both the departing information and the parking information, as shown in FIG. 4B. The driver of the vehicle A can recognize that a vehicle to depart and a vehicle to be parked are present; however, he needs to determine which vehicle of the vehicle A and the vehicle B is about to depart by himself. In contrast, in FIG. 4C, the vehicle A receives only the departing information from the vehicle B. In this case, the driver of the vehicle A can easily determine that the vehicle B is about to depart. Further, even if the vehicle A receives the parking information from the vehicle B, the driver of the vehicle A can also easily determine that the vehicle B is about to be parked.

In the above first and second notifications, only the presence of a vehicle to depart or a vehicle to be parked is notified. However, when a notification includes vehicle-designating information that can designate a vehicle, the user notified of the notification can easily designate the relevant vehicle. Such notification processes will be explained below using two examples. Here, it is assumed that vehicle information is additionally notified in the process at S50 in FIG. 2 and at S250 in FIG. 3.

Vehicle information in this embodiment includes a number of a license plate, a vehicle kind, a vehicle color, and a vehicle class. The vehicle information is stored in the storage device 28. A number of a license plate, a vehicle kind, and a vehicle color require no additional explanation. A class is exemplified by a light car, a one box, a mini-ban, a sedan, or the like. Namely, the class is preferably categorized by items generally recognized by the public. The vehicle information is used for a user who is searching a parking space to easily determine the relevant vehicle. When a license plate is easily recognized by the above user, it is no problem. However, it is sometimes difficult to recognize the license plate for a user who is seated in a driver's seat in a vehicle. Therefore, other information such as a vehicle kind, a vehicle color, and a vehicle class are used in this embodiment. The vehicle color is very useful information in this case. The vehicle kind includes so many kinds, so that it is difficult for a user to recognize all the kinds. Therefore, sketchy or rough categorization, e.g., vehicle shapes, are preferably used. When, in particular, a vehicle color and a vehicle class are designated, the relevant vehicle can be narrowed down.

Third Notification Process

The flow chart of a third notification process is shown in FIG. 6A. In this first notification process, only the departing information accompanied by vehicle information is notified. This process is started when the ignition switch is turned on.

First, it is determined whether the departing information is received via the wireless communications unit 30 (S610). The process at S610 is repeated until the departing information is received. When the departing information is received (S610: YES), the sequence advances to S620. At S620, the vehicle information of the vehicle to depart is notified to a user (or driver) by displaying it on the screen of the display device 26 and by outputting speech from the sound output device 27. In this notification, the number of a license plate, a vehicle kind, a vehicle color, and a vehicle class are included. In the display in the display device 26, for instance, the number of a license plate, a vehicle kind, a vehicle color, and a vehicle class are listed as shown in FIG. 6C. There is a case that several vehicles are included as the vehicle to depart, so that the relevant vehicles are displayed with row numbers 1, 2, 3 in an order of receiving the departing information. After the process at S620 is completed, the process returns to S610.

Thus, not only the presence of a vehicle to depart but also the vehicle information of the vehicle to depart is notified, so that the user that is searching the usable parking space can easily find the vehicle that is currently parked and is about to depart from the parking space by using the notified vehicle information. For instance, in FIG. 6B, the vehicle A that searches a parking space receives the departing information from the vehicle B and the parking information from the vehicle C. In this case, the driver of the vehicle A is notified of the vehicle information of the vehicle B, so that the driver can easily determine which vehicle of the vehicle B and the vehicle C is about to depart by using the notified vehicle information. Further, suppose a case that the vehicle C is also a vehicle to depart and outputs departing information. In this case, as shown in FIG. 6C, the vehicle information of the vehicle B, and the vehicle C are listed. Therefore, by using the listed vehicle information, the driver of the vehicle A can find the relevant vehicle.

Fourth Notification Process

Figures 7A, 7B:
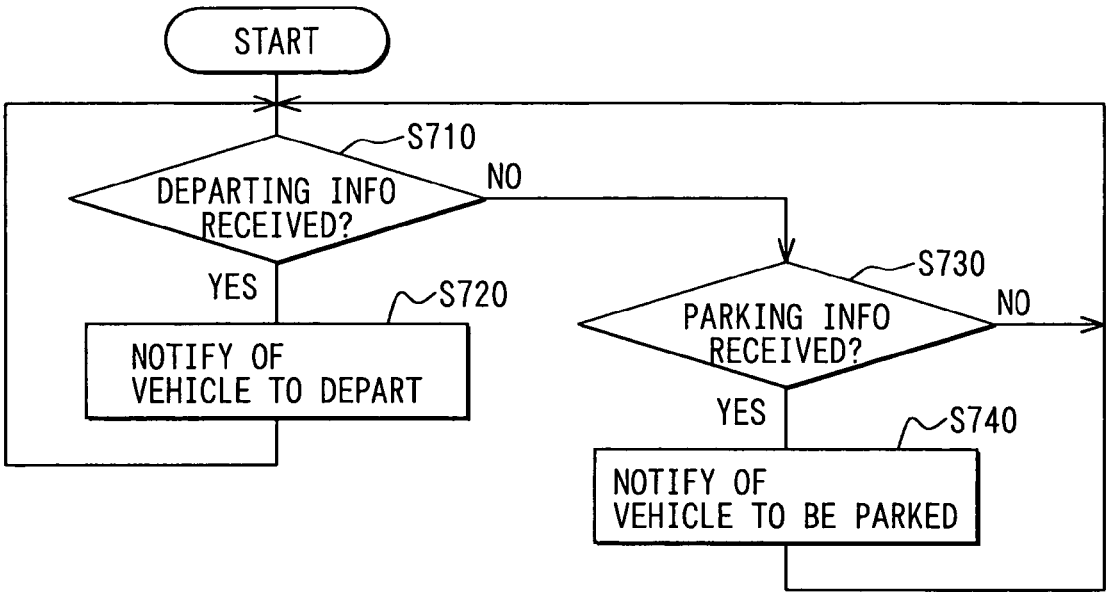
FIG. 7A is a flow chart diagram of a fourth notification process using vehicle information.
FIG. 7B is a diagram for explaining the fourth modification process.

The flow chart of a fourth notification process is shown in FIG. 7A. In this fourth notification process, the departing information and the parking information are notified with their corresponding vehicle information. This process is started when the ignition switch is turned on.

First, it is determined whether the departing information is received via the wireless communications unit 30 (S710). When the departing information is received (S710: YES), the sequence advances to S720. At S720, the vehicle information of the vehicle to depart is notified to a user (or driver) by displaying it on the screen of the display device 26 and by outputting speech from the sound output device 27. In this notification, the number of a license plate, a vehicle kind, a vehicle color, and a vehicle class are included. In the display in the display device 26, for instance, the number of a license plate, a vehicle kind, a vehicle color, and a vehicle class are listed as shown in the upper portion in FIG. 7B. There is a case that several vehicles are included as the vehicle to depart, so that the relevant vehicles are displayed with row numbers 1, 2, 3 in an order of receiving the departing information. After the process at S720 is completed, the process returns to S710.

In contrast, when the departing information is not received (S710: NO), the sequence advances to S730. At S730, it is determined whether the parking information is received via the wireless communications unit 30. When the parking information is received (S730: YES), the sequence advances to S740. At S740, the vehicle information of the vehicle to be parked is notified to a user (or driver) by displaying it on the screen of the display device 26 and by outputting speech from the sound output device 27. In this notification, the number of a license plate, a vehicle kind, a vehicle color, and a vehicle class are included. In the display in the display device 26, for instance, the number of a license plate, a vehicle kind, a vehicle color, and a vehicle class are listed as shown in the lower portion of FIG. 7B. There is a case that several vehicles are included as the vehicle to be parked, so that the relevant vehicles are displayed with row numbers 1, 2, 3 in an order of receiving the parking information. Here, the lists for the departing information and the parking information are simultaneously shown in the same page on the screen in the display device 26, as shown in FIG. 7B. After the process at S740 is completed, the process returns to S710. Further, the determination at S730 is negated, the sequence also returns to S710.

Thus, the presences of a vehicle to depart and a vehicle to be parked are notified along with the corresponding vehicle information, so that the user that is searching the usable parking space can easily find the vehicle that is currently parked and is about to depart from the parking space by using the notified vehicle information. For instance, suppose a case that the vehicle A receives the departing information from the vehicle B and the parking information from the vehicle C. In this case, as in FIG. 7B, the vehicle information of the vehicle B is shown in the first row of "DEPART 1" while the vehicle information of the vehicle C is shown in the first row of "PARKED 1." The driver of the vehicle A can thereby easily determine which vehicle of the vehicle B and the vehicle C is about to depart by using the notified vehicle information.

(Others)

Figure 2:
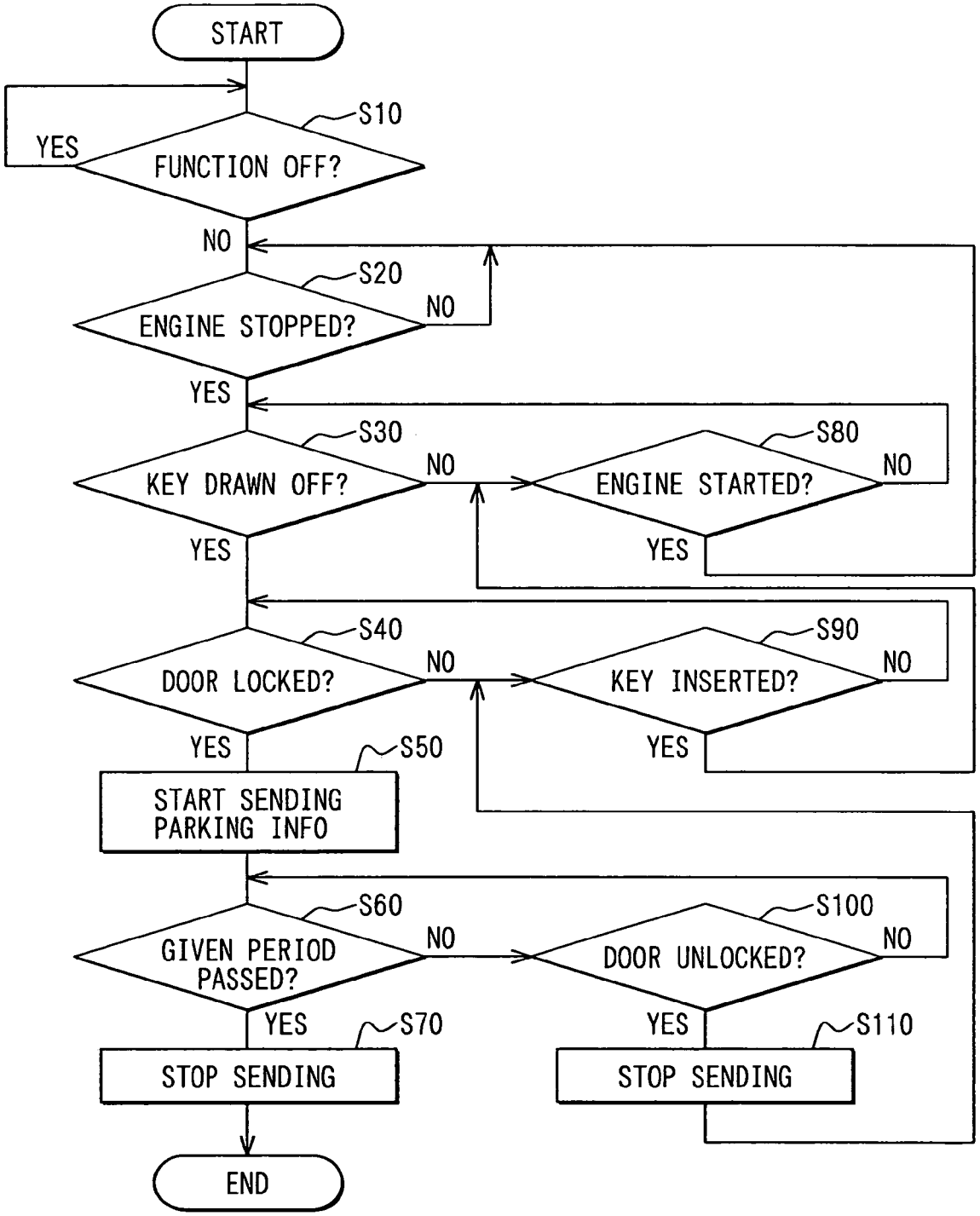
FIG. 2 is a flow chart diagram of a process for sending information when a vehicle is to be parked.
Figure 3:
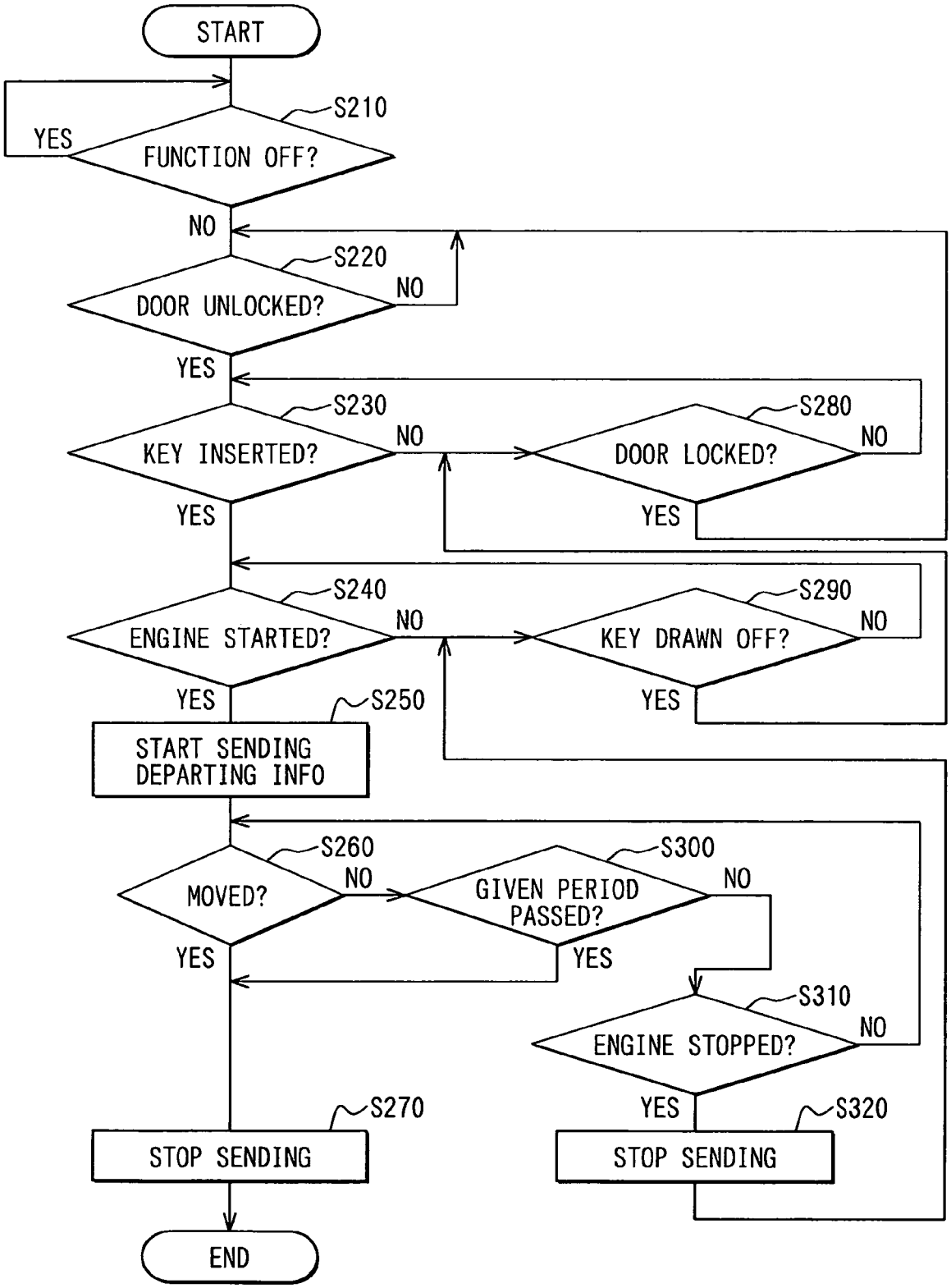
FIG. 3 is a flow chart diagram of a process for sending information when a vehicle is to depart from a parking space.

(a) In the above embodiment, as shown in FIGS. 2, 3, when the information sending function is turned on, the departing information and the parking information are sent with given conditions satisfied. However, in practice, when a communications unit 30 that is notified of departing information or parking information is not present, it is useless to send the information. Therefore, it can be designed that the information is sent only when a request for sending is sent from an information recipient. This decreases the useless transmission.

Figure 8:
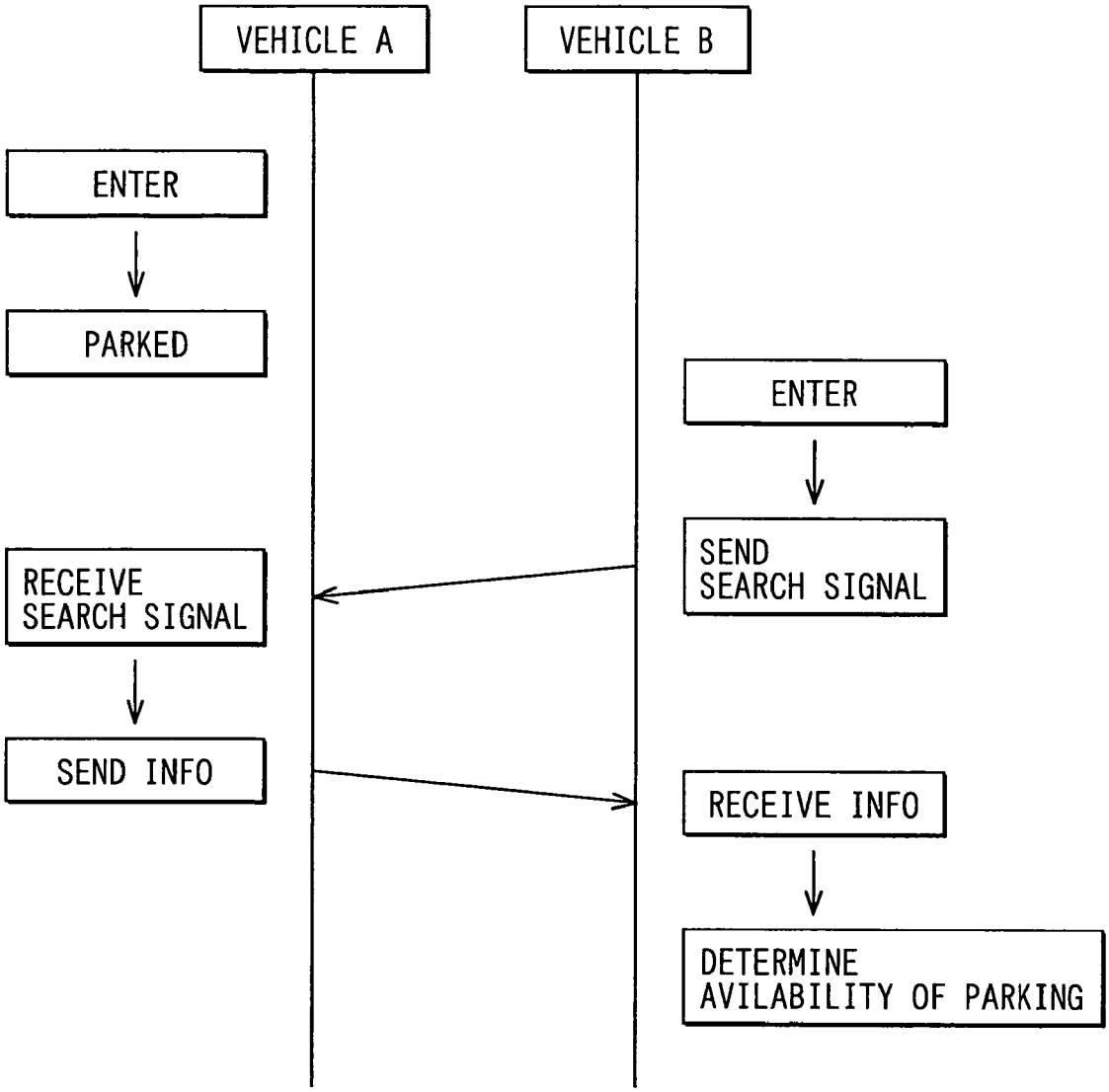
FIG. 8 is a diagram for explaining another embodiment of the present invention.

For instance, as shown in FIG. 8, a vehicle B that enters a parking structure outputs a parking space search signal. In this case, the communications system 1 of the vehicle B is capable of outputting the parking space search signal. For instance, when the vehicle B enters the parking structure, the driver of the vehicle B can output the signal by manipulating the manipulation switch group 22. Otherwise, it is designed that the communications system 1 automatically determines that the vehicle B enters the parking structure by using current position designating function to then output the signal.

In contrast, in the communications system 1 of the vehicle A (in FIG. 8) that has been already parked, "whether the function is off or not" in S10 in FIG. 2 and in S210 in FIG. 3 is replaced with "whether a parking space search signal is received or not." Only when the parking space search signal is received, the process at S20 and the subsequent steps in FIG. 2 and the process at S220 and the subsequent steps can take place. In this modified process, as needed, or only when there is a driver of a vehicle searching a parking space, parking information or departing information can be outputted, which decreases useless power consumption.

(b) In the above embodiment, information whether a vehicle is to depart or to be parked, or the information accompanied by the corresponding vehicle information is outputted. Here, the departing information can include "how many seconds are required before the vehicle will depart." For instance, in such a case that it takes a relatively longer time period for a senior person or a baby to get in a vehicle, a user or driver sets an estimated time period to the departure. The set time period to the departure can be thereby outputted along with the departing information. Otherwise, instead of manual setting, an average time period computed from the passed history can be automatically set. Here, in computing the average, data at the home or data at the office can be preferably eliminated. It is because the time period to the departure at the home is not seriously considered. Further, it is because there is few cases that a senior person or baby gets in the vehicle at the office. Therefore, eliminating the data at the home and at the office increases the data experienced only when the senior person or the baby gets in the vehicle, which provides the proper data value.

(c) In the above embodiment, as shown in FIGS. 2, 3, the parking information or the departing information is sent only when three conditions of the engine state, the key state, and the door-lock state are satisfied. However, before the three conditions are satisfied, the information can be outputted by weighting the information or adding the present states. For instance, regarding weighting the information, the rank A, the rank B, and the rank C are assigned to "just before departure," "preparing departure," and "about to be seated," respectively. For instance, fixing a seat belt indicates "just before departure." Releasing the parking brake although not fixing the seat belt indicates "preparing departure." Starting engine although the door opened indicates "about to be seated." On the other hand, regarding the state, the door-lock release, the key insertion, and the engine start can be used.

Further, when a vehicle uses a key free system, whether a person near a certain vehicle is a would-be occupant can be determined by using this system.

(d) Suppose a case that the vehicle A to depart from a parking space is present and the vehicle B is waiting in a certain space, e.g., passage, for the vehicle B to depart. In this case, the driver of the vehicle C following the vehicle B does not know the reason why the vehicle B is stopping in the passage, so that the driver of the vehicle B may become uncomfortable to thereby sound a horn. This may bring about a trouble. To prevent this trouble, the stopping reason of the vehicle B can be sent the following vehicle C to relieve the driver of the vehicle C.

In detail, the effect that this vehicle B is waiting for the parked vehicle to depart is outwardly outputted from the vehicle B when the vehicle B stops based on the notification of the presence of a vehicle to depart or a vehicle to be parked without or with the corresponding vehicle information. Here, as explained in the above (b), the estimated time period for waiting can be included in the outputted information. Further, the vehicle information can be also additional outputted at this timing. Thus, the driver of the following vehicle C can clearly recognize that the preceding vehicle B is waiting for the vehicle A to depart.

(e) Regarding the communications area of the wireless communications unit 30, its directionality of sending the departing information or the parking information can be changed according to the direction of the vehicle to be parked. When the vehicle is parked backward (i.e., when the driver backs the vehicle to park it), the communications area is formed frontward. In contrast, when the vehicle is parked frontward (i.e., when the driver advances the vehicle frontward to park it), the communications area is formed backward. The direction of the parked vehicle can be determined based on the traveling track just before the vehicle is parked.

(f) When the control circuit 29 in the system can be achieved as a program executed by a computer. This program can be stored, e.g., in a computer-readable storage medium such as a flexible disk, a magnetic optical disk, a CD-ROM, a storage device, a ROM, or a RAM; the program can be downloaded to the computer and executed, as needed. Further, the program can be downloaded via a communications network.

It will be obvious to those skilled in the art that various changes may be made in the above-described embodiments of the present invention. However, the scope of the present invention should be determined by the following claims.

What is claimed is:

1. A communications system provided in a vehicle, the communications system comprising:

a communicating unit that has a wireless communications area to execute an inter-vehicle communications with another communication system configured for cooperative communication;

a vehicle state detecting unit that detects at least one state of the vehicle; and a controlling unit that controls various controls, wherein the controlling unit includes:

a determining unit that determines at least one of whether the vehicle enters a parked state where the vehicle is to be parked and whether the vehicle enters a departing state where the vehicle is to depart based on the vehicle state detected by the vehicle state detecting means; and a transmission controlling unit that causes the communicating unit to send parking information indicating that the vehicle enters the parked state when that the vehicle enters the parked state is determined, and departing information indicating that the vehicle enters the departing state when the vehicle enters the departing state is determined; and a notifying unit that executes, when at least one of parking information and departing information is received from the another communications system via the communicating unit, at least one of a notification indicating that a vehicle to be parked is present and a notification indicating that a vehicle to depart is present based on the received at least one of parking information and departing information, respectively.

2. The communications system of claim 1, wherein the vehicle state detecting unit detects at least one of an engine operating state and a door-lock state, and wherein the determining unit determines that the vehicle enters the parked state in a case where an engine of the vehicle is stopped and a door of the vehicle is locked, wherein the determining unit determines that the vehicle enters the departing state in a case where the door is unlocked and the engine is started.

3. The communications system of claim 2, wherein the vehicle state detecting unit that is capable of detecting whether the vehicle starts moving, wherein, after sending the parking information is started, the transmission controlling unit stops sending the parking information when a give period passes without the door being unlocked, and stops sending the parking information when the door is unlocked before the given period passes, and wherein, after sending the departing information is started, the transmission controlling unit stops sending the departing information when it is determined by the vehicle state detecting unit that the vehicle starts moving, stops sending the departing information when a certain period passes without the engine being stopped even while it is not determined that the vehicle starts moving, and stops sending the departing information when the engine is stopped before the certain period passes even while it is not determined that the vehicle starts moving.

4. The communications system of claim 1, further comprising:

a vehicle information storing unit that stores vehicle information that designates the vehicle in which the communications system is mounted, wherein the transmission controlling unit sends the vehicle information in addition to the parking information or the departing information, and wherein the notifying unit notifies, when vehicle information of a certain vehicle is received from another communications system, information that enables the certain vehicle to be designated based on the received vehicle information.

5. The communications system of claim 4, wherein the vehicle information includes at least one of a number of a license plate, a vehicle kind, a vehicle color, and a vehicle class.

6. The communications system of claim 1, wherein the notifying unit notifies a driver of the vehicle of information that is visible.

7. The communications system of claim 1, wherein the controlling unit includes:

a function selection accepting unit that accepts a selection of whether a function for sending the departing information is valid or invalid, and wherein the controlling unit causes determination by the determining unit and transmission control by the transmission controlling unit while that the function for sending the departing information is valid is accepted.

8. The communications system of claim 1, wherein the controlling unit includes:

a search signal transmission controlling unit that causes the transmission controlling unit to send a parking space search signal indicating that a parking space is being searched, and wherein the controlling unit causes determination by the determining unit and transmission control by the transmission controlling unit after a search signal is received from another communications system via the communicating unit.

9. The communications system of claim 8, further comprising:

an entry determining unit that determines whether the vehicle enters a parking area including a plurality of parking spaces, wherein the search signal transmission controlling unit causes the transmission controlling unit to send a parking space search signal after it is determined that the vehicle enters the parking area.

10. The communications system of claim 1, wherein the determining unit further determines a conditional level for entering the parked state or the departing state based on the vehicle state detected by the vehicle state detecting unit, wherein the transmission controlling unit sends the conditional level in addition to the parking information or the departing information, and wherein the notifying unit further notifies, the received conditional level.

11. The communications system of claim 1, wherein the vehicle state detecting unit is capable of detecting a plurality of vehicle states, wherein a condition for entering the parked state or a condition for entering the departing state is satisfied when the plurality of vehicle states become predetermined levels, wherein the determining unit further determines whether some of the plurality of vehicle states become the predetermined levels, wherein, when that some of the plurality of vehicle states become the predetermined levels is determined, the transmission controlling unit further sends that some of the plurality of vehicle states become the predetermined levels, and wherein, the notifying unit further notifies an effect that some of a plurality of vehicle states become predetermined levels when the effect is received from another communications system.

12. The communications system of claim 1, wherein the vehicle state detecting unit is capable of detecting whether the vehicle is stopped, wherein the controlling unit includes:

a stopping reason transmission control unit causes the communicating unit to send information indicating that the vehicle is waiting for a parked vehicle to depart in a case where departing information is received from another communications system via the communicating unit and that the vehicle is stopped is detected, and wherein the notifying unit notifies waiting information indicating that a vehicle is waiting for a parked vehicle to depart when the waiting information is received from another communications system via the communicating unit.

13. The communications system of claim 1, wherein the communicating unit is capable of changing directionality of the wireless communications area, wherein the vehicle state detecting unit is capable of detecting whether the vehicle enters a parking space frontward or backward, and wherein a directionality control unit that controls directionality of the communications area to cause the directionality of the wireless communications area to extend frontward when the vehicle enters the parking space backward and to cause the directionality to extend backward when the vehicle enters the parking space frontward.

14. The communications system of claim 1, further comprising:

a vehicle information storing unit that stores vehicle information that designates the vehicle in which the communications system is mounted, wherein the transmission controlling unit further sends the vehicle information in addition to the parking information or the departing information.

15. A computer program product in a computer-readable medium for use in a communications system that is provided in a vehicle and includes a communicating unit that has a wireless communications area to execute an inter-vehicle communications with another communication system configured for cooperative communication, the computer program product comprising:

instructions for detecting at least one state of the vehicle; and instructions for determining at least one of whether the vehicle enters a parked state where the vehicle is to be parked and whether the vehicle enters a departing state where the vehicle is to depart based on the detected vehicle state; and instructions for sending, via the communicating unit, parking information indicating that the vehicle enters the parked state when the vehicle enters the parked state is determined, and departing information indicating that the vehicle enters the departing state when that the vehicle enters the departing state is determined instructions for executing, when at least one of parking information and departing information is received from another communications system via the communicating unit, at least one of a notification indicating that a vehicle to be parked is present and a notification indicating that a vehicle to depart is present based on the received at least one of parking information and departing information, respectively.

* * * * *